US009083154B2

(12) United States Patent
Niessner et al.

(10) Patent No.: US 9,083,154 B2
(45) Date of Patent: Jul. 14, 2015

(54) SPARK PLUG

(71) Applicant: FEDERAL-MOGUL IGNITION GmbH, Neuhas-Schierschnitz (DE)

(72) Inventors: Werner Niessner, Steinheim (DE); Alexander Schenk, Waiblingen (DE)

(73) Assignee: Federal-Mogul Ignition GmbH, Wiesbaden (DE)

( * ) Notice: Subject to any disclaimer, the term of this patent is extended or adjusted under 35 U.S.C. 154(b) by 0 days.

(21) Appl. No.: 13/973,247

(22) Filed: Aug. 22, 2013

(65) Prior Publication Data

US 2014/0055023 A1 Feb. 27, 2014

(30) Foreign Application Priority Data

Aug. 23, 2012 (DE) ..... 10 2012 107 771

(51) Int. Cl.
*H01T 13/39* (2006.01)

(52) U.S. Cl.
CPC ..... *H01T 13/39* (2013.01)

(58) Field of Classification Search
CPC . G01R 31/3627; G01R 31/3682; H01T 13/39
USPC ..... 313/118, 141, 142, 143
See application file for complete search history.

(56) References Cited

U.S. PATENT DOCUMENTS 2,642,053 A * 6/1953 Dowson ..... 313/141
4,488,081 A * 12/1984 Kondo et al. ..... 313/141
4,514,657 A * 4/1985 Igashira et al. ..... 313/130
5,510,667 A * 4/1996 Loffler et al. ..... 313/141
6,642,638 B2 * 11/2003 Ishiguro ..... 313/141
6,724,132 B2 * 4/2004 Kanao ..... 313/141
6,794,803 B2 * 9/2004 Hori et al. ..... 313/141
6,923,699 B2 * 8/2005 Matsubara et al. ..... 445/7
7,084,558 B2 * 8/2006 Teramura et al. ..... 313/141
7,321,187 B2 * 1/2008 Teramura et al. ..... 313/141
7,808,165 B2 * 10/2010 Kowalski ..... 313/141
8,013,503 B2 * 9/2011 Kameda et al. ..... 313/141
8,013,504 B2 * 9/2011 Kameda et al. ..... 313/141
8,138,660 B2 * 3/2012 Nakamura et al. ..... 313/143
8,247,740 B2 * 8/2012 Nakayama et al. ..... 219/270
8,766,520 B2 * 7/2014 Boehler et al. ..... 313/141
2002/0003389 A1 * 1/2002 Ishiguro ..... 313/141
2004/0041506 A1 * 3/2004 Teramura et al. ..... 313/141
2006/0238092 A1 * 10/2006 Teramura et al. ..... 313/141
2007/0290593 A1 * 12/2007 Kowalski ..... 313/141
2009/0134764 A1 * 5/2009 Kameda et al. ..... 313/141
2009/0140624 A1 * 6/2009 Kameda et al. ..... 313/141
2009/0289539 A1 * 11/2009 Sakakura ..... 313/141

(Continued)

FOREIGN PATENT DOCUMENTS

DE 10133229 A1 2/2002

*Primary Examiner* — Thomas A Hollweg
(74) *Attorney, Agent, or Firm* — Reising Ethington P.C.

(57) ABSTRACT

A spark plug having a spark plug body, a center electrode, and a rod-shaped ground electrode that is attached to a front end of the spark plug body and has an electrode end section with an end surface and two side surfaces. The electrode end section is provided with a step onto which is attached a precious metal component with an ignition surface that, together with the center electrode, forms a spark air gap. The step formed in the electrode end section and the precious metal component attached thereto extend across the entire width (B) of the electrode end section so that the precious metal component is flush with the electrode end section on the two sides surfaces, as well as the end surface.

9 Claims, 3 Drawing Sheets

(56) References Cited

U.S. PATENT DOCUMENTS

2011/0037373 A1* 2/2011 Nakamura et al. ..... 313/141
2011/0279009 A1* 11/2011 Quitmeyer et al. ..... 313/141
2013/0009539 A1* 1/2013 Quitmeyer et al. ..... 313/142
2013/0234580 A1* 9/2013 Boehler et al. ..... 313/141

* cited by examiner

SPARK PLUG

REFERENCE TO RELATED APPLICATIONS

This application claims the benefit of German Patent Application No. DE 10 2012 107 771.1, filed on Aug. 23, 2012, the entire contents of which are incorporated herein.

TECHNICAL FIELD

The invention generally relates to a spark plug and, in particular, to a spark plug that may be used in an internal combustion engine, such as an indirect injection engine equipped with some type of pre-chamber.

BACKGROUND

A spark plug is known from DE 101 33 229 A1. Usually, a precious metal component situated on the ground electrode is embedded in the material of the ground electrode in order to achieve a good dissipation of heat from the precious metal component. In this case, all of the side surfaces of the precious metal component, which are oriented in the longitudinal direction of the spark plug and transversely relative to the ignition surface of the precious metal component, are at least partially covered by the material of the ground electrode. The width of the ground electrode is therefore greater than the width of the precious metal component. In addition, the precious metal component does not extend all the way to the end surface of the ground electrode, but is instead slightly recessed from the end surface of the ground electrode. As a result, the precious metal component can be welded to the ground electrode along its entire circumference encompassing the ignition surface. In an exemplary embodiment from DE 101 33 229 A1, a block-shaped precious metal component is disclosed, which is situated flush with the end surface of the ground electrode. The precious metal component is nevertheless still embedded in the material of the ground electrode. It is at least partially covered by the material of the ground electrode on its two side surfaces, i.e., on a total of four out of its six surfaces.

The development of such spark plugs has already been pushed to its limits on the whole. The spark plugs have a service life that is quite long and have an operational reliability that is quite high. Development is only progressing in small steps, since it is difficult to achieve further improvements.

In the known embodiments of the ground electrode, it has been observed that cracks and chips can occur in the precious metal component, which result in ignition problems and a failure to achieve the desired service life. In such cases, the spark plug must be replaced before the next regularly scheduled maintenance of the gasoline engine, i.e., an unplanned disruption in operation.

SUMMARY

One potential object is to improve the operational reliability of a spark plug of the type previously mentioned and to increase its service life. This object may be attained by means of a spark plug with the features recited in the claims.

According to one embodiment, there is provided a spark plug having a center electrode, a longitudinal direction extending parallel to the center electrode, a spark plug body with a front end and rear end, and a rod-shaped ground electrode designed so that the ground electrode is attached to the front end of the spark plug body. The spark plug can include an inner conductor and an insulator surrounding the inner conductor, the center electrode being connected to the inner conductor and the insulator being accommodated in the spark plug body. The longitudinal direction of the spark plug extends along the spark plug body, from its front end to its rear end. The rod-shaped ground electrode has an electrode end section extending transversely relative to the longitudinal direction of the spark plug. In particular, the electrode end section extends perpendicular to the longitudinal direction and protrudes toward the center electrode. The electrode end section of the ground electrode has an end surface and two side surfaces. The side surfaces are oriented in the longitudinal direction of the spark plug, define a width of the electrode end section oriented transversely relative to the longitudinal direction of the spark plug, and are connected to each other by an end surface likewise oriented in the longitudinal direction of the spark plug. In a viewing direction oriented parallel to the electrode end section, the end surface of the ground electrode therefore has a width extending transversely relative to the longitudinal direction of the spark plug and a height extending in the longitudinal direction. Preferably, surfaces oriented in the longitudinal direction of the spark plug extend parallel to the longitudinal direction. Surfaces or dimensions extending transversely relative to the longitudinal direction of the spark plug are preferably perpendicular to the longitudinal direction of the spark plug.

The electrode end section of the ground electrode may be provided with a step onto which a precious metal component is welded. The precious metal component ends flush with the electrode end section at the end surface of the ground electrode and has an ignition surface, which extends transversely relative to the end surface of the ground electrode and, together with the center electrode, forms a spark air gap. The spark air gap is formed with an end surface of the center electrode extending transversely relative to the longitudinal direction of the spark plug. The ignition surface of the precious metal component is preferably parallel to the end surface of the center electrode. The step in the electrode end section extends over part of the height of the end surface of the ground electrode so that the end surface is partially comprised by the precious metal component. The step embodied in the electrode end section and the precious metal component situated on it extend across the entire width of the electrode end section so that the precious metal component ends flush with the electrode end section at both side surfaces of the ground electrode. The step and the precious metal component therefore both extend across the entire width of the end surface, but each in a different height range of the end surface.

In the design of a spark plug, the size of the ignition surface may be determined based on the required service life and other conditions of use. With an unchanged size and width of the ignition surface of the precious metal component, the embodiment according to the invention permits the width of the electrode end section to be reduced since the precious metal component is no longer covered by the material of the ground electrode on both side surfaces. A reduced width of the ground electrode results in a reduced cross-sectional area of the ground electrode when the dimensions otherwise remain the same. One may expect a reduced cross-sectional area of the ground electrode to be accompanied by a reduced dissipation of heat from the electrode end section to the spark plug body during operation and therefore result in higher temperatures in the electrode end section. Surprisingly, however, with this particular embodiment, it has turned out that the temperatures occurring in the precious metal component and the electrode end section of the ground electrode that occur during operation are actually reduced. Depending on the spark plug, it was possible to sometimes achieve temperature reductions of approximately 100° C. A potential advantage of this embodiment is the fact that the spark plug is suitable for applications involving high thermal demands.

Another potential advantage of this embodiment lies in the fact that the precious metal component that is flush with the side surfaces of the ground electrode is accessible so that a weld can be produced on the side surfaces. On the side surfaces, the precious metal component can be welded with a welding seam that extends along an interstice between the precious metal component and the electrode end section. The alternative welding options permit an optimized welding and improved attachment of the precious metal component, which reduces cracking and spalling during operation.

On the whole, including when used in internal combustion engines equipped with some type of pre-chamber, it has been possible for the spark plug of this embodiment to achieve increased ignition reliability and an extended service life.

It may be advantageous if the two side surfaces of the ground electrode extend parallel to each other at least in the electrode end section. The rod-shaped ground electrode can be welded to the end surface at the front end of the spark plug body and can have a bend so that the electrode end section extends perpendicular to the longitudinal direction of the spark plug. The rod-shaped ground electrode has two ends; a first end is welded to the spark plug body and a second end protrudes from the spark plug body toward the center electrode in the radial direction and includes the electrode end section. The end of the ground electrode protruding toward the center electrode is defined by the end surface. In one potential embodiment, the front end of the spark plug body has a cam-like extension onto which is welded a rod-shaped ground electrode that extends in a straight line. In this case, the ground electrode can be welded onto the end surface of the cam-like extension or onto its inner surface that is oriented toward the center electrode. This embodiment may yield a further temperature reduction of the center electrode. This also may make it possible to eliminate the work step of the bending the ground electrode when manufacturing the spark plug.

According to another embodiment, the precious metal component and the electrode end section are welded with a welding seam that forms an alloy zone composed of the materials of the precious metal component and the electrode end section, with the welding seam extending along an interstice between the precious metal component and the electrode end section. The precious metal component is preferably welded to the electrode end section along an interstice on the end surface of the ground electrode, along an interstice on the surface of the ground electrode oriented toward the center electrode, and along interstices on the two side surfaces of the ground electrode, which define the width of the end surface, forming alloys zones extending along the interstices. It may be preferable for the precious metal component to be completely welded to the electrode end section along all of the interstices. This can produce a good, lasting connection of the precious metal component to the ground electrode.

In one embodiment, the precious metal component can be block-shaped and the end surface of the ground electrode can lie in a plane extending parallel to the longitudinal direction of the spark plug. In another embodiment, the precious metal component can be disk-shaped and the end surface of the ground electrode can be embodied in the form of a part of a circumference surface of a circular cylinder whose longitudinal axis extends parallel to the longitudinal direction of the spark plug. It may be advantageous if the shape of the step in the electrode end section is adapted to an external form of the precious metal component that encompasses the ignition surface.

It can be advantageous if the ignition surface of the precious metal component ends flush with a surface of the electrode end section that adjoins the precious metal component and is oriented toward the center electrode. Alternatively, it can be advantageous if the ignition surface of the precious metal component protrudes in step fashion above a surface of the electrode end section that adjoins the precious metal component and is oriented toward the center electrode, with a height of 0.1 mm to 0.8 mm or with a height of 0.2 mm to 0.4 mm, for example. It can be advantageous for the ground electrode to have a copper core in order to improve heat dissipation. The copper core may be encompassed by a material composed of a high-temperature-resistant nickel-based alloy. The precious metal component can preferably be composed of an iridium-containing material so that it is very wear-resistant.

It should be appreciated that the aforementioned embodiments, components, arrangements, features, advantages, etc. are simply meant to illustrate some possibilities and that the present spark plug is not limited thereto. Accordingly, the present spark plug may use or be provided according to any of the embodiments, components, arrangements, features, advantages, etc. listed above, as well as others that are not listed.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
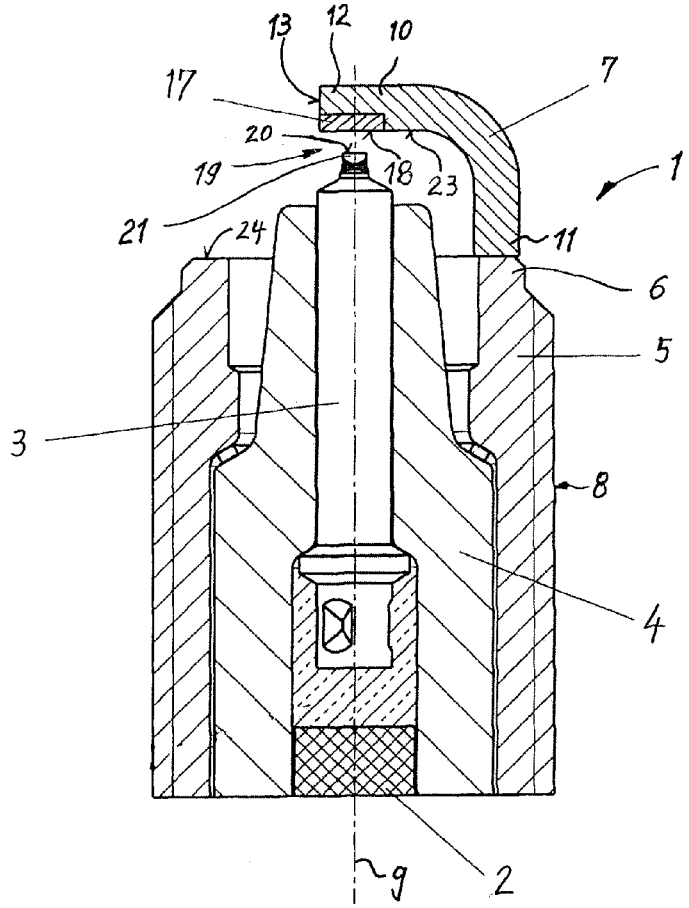
FIG. 1 shows an enlarged, partially depicted longitudinal section through a spark plug according to an exemplary embodiment.

FIG. 1 shows a partially depicted spark plug 1 for an internal combustion engine, such as one equipped with some type of pre-chamber. The spark plug has an inner conductor 2 and a center electrode 3 connected to the inner conductor; an insulator 4 encompassing the inner conductor 2; a spark plug body 5, which contains the insulator 4 and has a front end 6 and a rear end that is not shown; and a rod-shaped ground electrode 7. At the rear end of the spark plug body 5 (not shown), the inner conductor 2 protrudes from the insulator 4, which in turn protrudes from the spark plug body 5, and can be connected to an ignition voltage source in any known manner. The spark plug body 5 is provided with a thread 8 with which the spark plug 1 can be screwed into an internal combustion engine. The spark plug 1 has a longitudinal direction, which extends parallel to the center electrode 3 and parallel to the inner conductor 2 and is depicted by the dot-and-dash line labeled with the reference numeral 9 in FIG. 1.

The ground electrode 7 has an electrode end section 10 extending transversely relative to the longitudinal direction 9 of the spark plug 1. The rod-shaped ground electrode 7 has a first end 11 at which the ground electrode is attached to the front end 6 of the spark plug body 5. The second end 12 of the rod-shaped ground electrode 7 includes the electrode end section 10 and protrudes toward the center electrode 3. In the electrode end section 10, the ground electrode 7 has an end surface 13 and has two side surfaces 14, 15 that are oriented in the longitudinal direction 9, define a width b of the electrode end section 10 extending transversely relative to the longitudinal direction 9, and are connected to each other by the end surface 13 likewise oriented in the longitudinal direction 9. The side surfaces 14, 15 are not visible in FIG. 1 since they extend parallel to the plane of the sectioned drawing, above and below it. The side surfaces 14, 15 and the width B of the electrode end section 10 are sometimes visible in FIGS. 2, 3, 5, and 9. Perpendicular to the width B, the end surface 13 has a height H extending in the longitudinal direction 9.

The electrode section 10 is provided with a step 16 onto which a precious metal component 17 is welded. The precious metal component is composed of an alloy predominantly containing iridium. The precious metal component 17 ends flush with the electrode end section 10 at the end surface 13 so that the end surface 13 is partially composed of the electrode end section 10 and partially composed of the precious metal component 17. The precious metal component 17 has an ignition surface 18, which is situated transversely relative to the end surface 13 and together with the center electrode 3, forms a spark air gap 19. The end surface 20 of the center electrode 3 situated perpendicular to the longitudinal direction 9 can be composed of an optional precious metal component 21 situated on the center electrode 3 so that the spark air gap 19 is formed between the precious metal component 17 and the precious metal component 21. In a different example, the precious metal component 17 forms the spark air gap 19 directly with an ignition surface of the center electrode 3, without the optional precious metal component 21.

Figure 2:
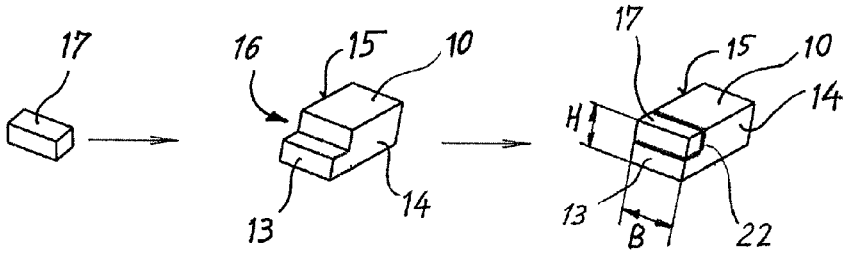
FIG. 2 is a perspective, partial depiction of a ground electrode according to an exemplary embodiment, during its manufacture.
Figure 3:
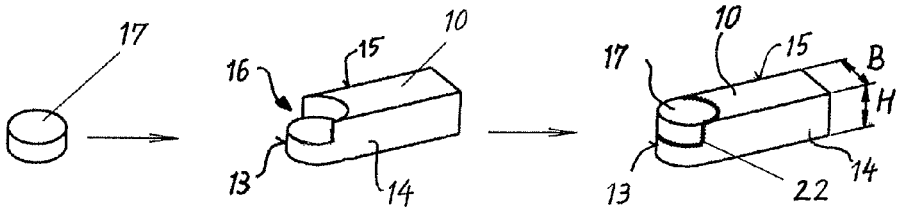
FIG. 3 is a view similar to FIG. 2 of an alternative embodiment of a ground electrode.

The embodiment of the precious metal component 17 and the step 16 adapted to it is particularly shown in FIGS. 2 and 3, each of which shows a perspective view of a ground electrode during its manufacture. The left side of FIG. 2 shows a previously produced block-shaped precious metal component 17. In the middle of FIG. 2, an electrode end section 10 of a ground electrode 7 with a step 16 is shown, onto which a precious metal component has not yet been placed. During the manufacture, the precious metal component 17 is then placed onto the step 16 and welded to the electrode end section 10. The right side of FIG. 2 shows a precious metal component 17 after it has been completely welded to the electrode end section 10. The interstice 22 between the precious metal component 17 and the electrode end section 10 has been welded all the way around with a laser beam or electrode beam so that an alloy zone is produced, which is composed of the materials of the precious metal component 17 and the electrode end section 10. In the embodiment according to FIG. 2, the end surface 13 of the ground electrode 7 is formed by a flat surface extending parallel to the longitudinal direction 9 of the spark plug 1, with the width B and the height H.

In FIG. 3, the precious metal component 17 is embodied as disk-shaped. The step 16 is adapted to the circular external form of disk 17 encompassing the ignition surface (see FIG. 3, middle) so that the precious metal component 17 can be inserted into the electrode end section 10 in a precisely-fitting fashion (see FIG. 3, right). The interstice 22 between the precious metal component 17 and the electrode end section 10 is once again welded all the way around by means of laser-beam or electrode-beam welding. In FIG. 3, the end surface 13 of the ground electrode 7 is embodied in the form of a part of a circumference surface of a circular cylinder whose longitudinal axis extends parallel to the longitudinal direction 9 of the spark plug 1. In a view with a viewing direction extending parallel to the electrode end section 10, the end surface 13 once again has a width B and a height H.

In FIGS. 2 and 3, it is clear that the step 16 embodied in the electrode end section 10 and the precious metal component 17 placed onto it extend across the entire width B of the electrode end section 10 and that the precious metal component 17 ends flush with the electrode end section 10 on both sides surfaces 14 and 15 of the ground electrode 7. The two sides surfaces 14 and 15 extend parallel to each other in the electrode end section 10 so that the width B of the electrode end section 10 corresponds to the width of the end surface 13. The width of the block-shaped precious metal component 17 and the diameter of the disk-shaped precious metal component 17 then correspond to the width B of the electrode end section 10. The precious metal component 17 and electrode end section 10 are welded along an interstice 22 on the surface 23 of the ground electrode 7 oriented toward the center electrode 3, along an interstice on the end surface 13 of the ground electrode 7, and along an interstice on both of the side surfaces 14 and 15 of the ground electrode 7 that define the width B of the end surface 13.

In the exemplary embodiment of FIG. 1, the first end 11 of the rod-shaped ground electrode 7 is welded to an end surface 24 at the front end 6 of the spark plug body 5. In this case, the end surface 24 can be embodied as a simple flat surface.

Figure 4:
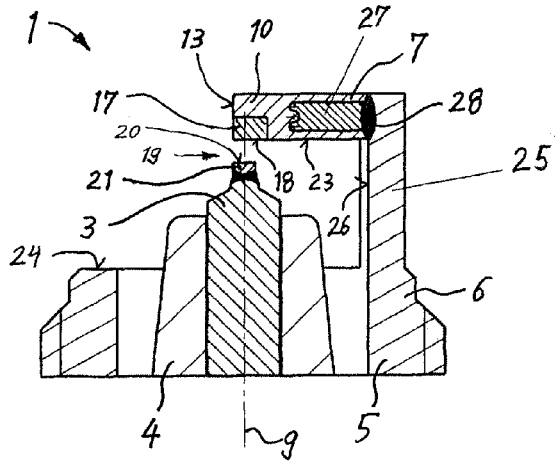
FIG. 4 is a view similar to FIG. 1 of a spark plug according to another exemplary embodiment.
Figure 5:
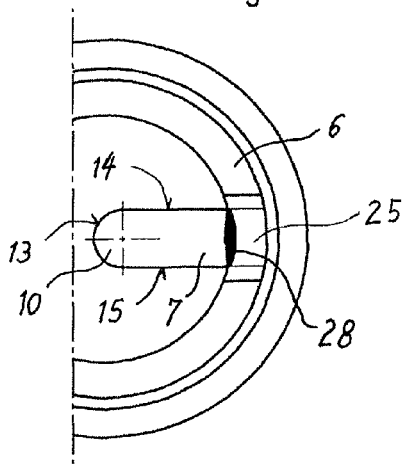
FIG. 5 is a partially depicted view in the direction of arrow v in FIG. 4.

In the embodiment shown in FIGS. 4 and 5, the end surface 24 of the spark plug body 5 has a cam-like extension 25. A rod-shaped ground electrode 7 that extends in a straight line is welded to an inner surface 26 of the cam-like extension 25 oriented toward the center electrode 3. The weld 28 between the ground electrode 7 and the cam-like extension 25 extends across the entire cross-section of the ground electrode 7 and can be a resistance weld, a laser weld, an electron-beam weld, or some combination thereof.

Depending on the requirements, the precious metal component 17 can be embodied as block-shaped like the one in FIG. 2 or as disk-shaped like the one in FIG. 3, but is not limited to these shapes. In order to improve the heat dissipation from the electrode end section 10, the ground electrode 7 can be provided with a copper core 27, see FIG. 4. The copper core 27 is embedded in the base material of the ground electrode 7, which may be composed of a high-temperature-resistant nickel-based alloy. In an embodiment that is not shown, a ground electrode that is welded directly onto the end surface 24 of the spark plug body 5, as in FIG. 1, can also have a copper core.

Figure 6:
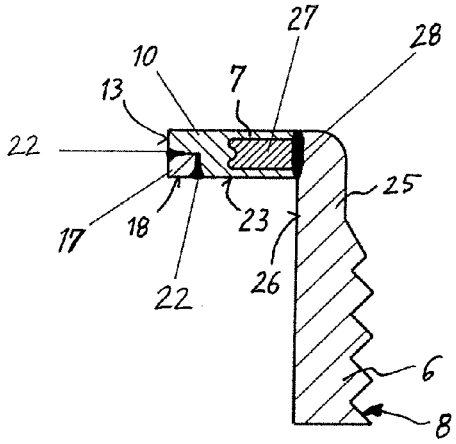
FIG. 6 is a view similar to FIG. 4 of a spark plug according to another exemplary embodiment.
Figure 7:
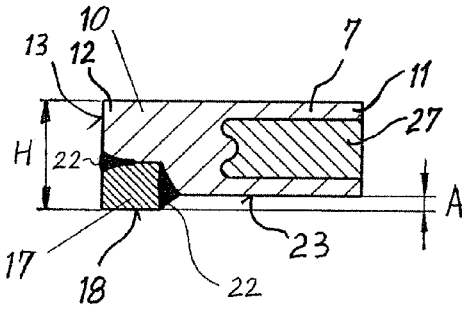
FIG. 7 is an enlarged view of the ground electrode of FIG. 6.

FIG. 6 shows an embodiment of the ground electrode 7 in which the ignition surface 18 of the precious metal component 17 ends flush with a surface 23 of the electrode end section 10 that adjoins the precious metal component 17 and is oriented toward the center electrode 3. The alloy zones of the welding seams extending along the interstices 22 between the precious metal component 17 and the electrode end section 10 are also indicated. In the variant of the ground electrode 7 shown in an enlarged depiction in FIG. 7, the ignition surface 18 protrudes beyond the surface 23 of the electrode end section 10 in step fashion, with a height A of 0.2 to 0.4 mm, for example. In this particular embodiment, the height H of the end surface 13 no longer corresponds to the height of the electrode end section 10, but is instead greater than it by the step height A.

Figure 8:
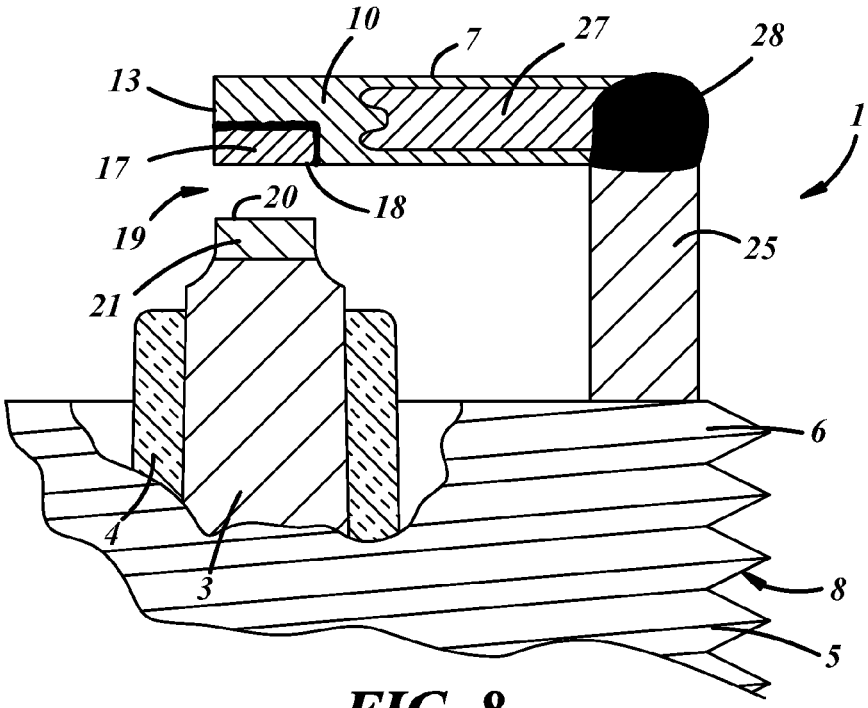
FIG. 8 is a view similar to FIG. 4 of a spark plug according to another exemplary embodiment.
Figure 9:
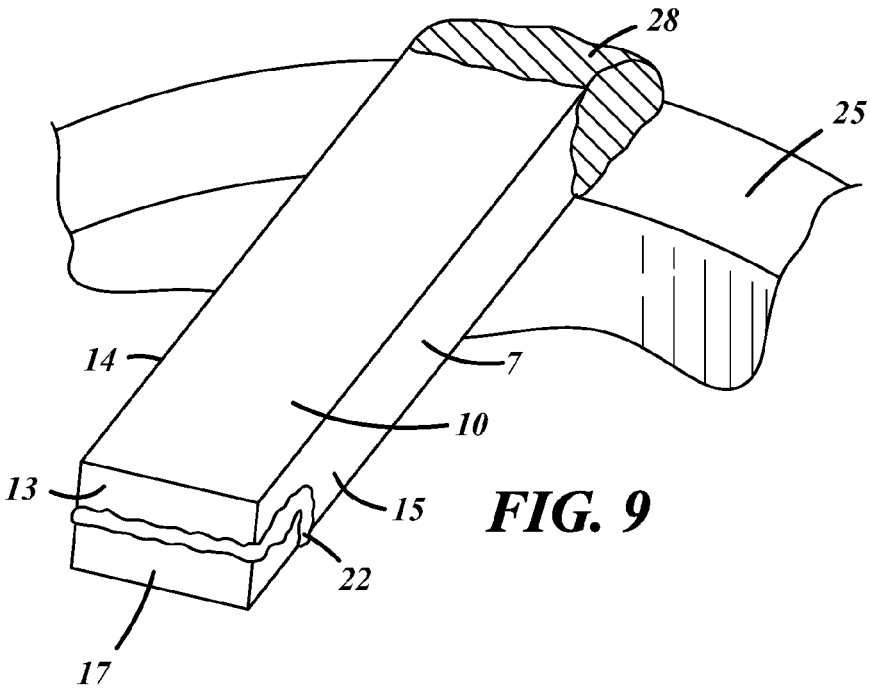
FIG. 9 is a perspective view of a ground electrode according to another exemplary embodiment.

Like the embodiment shown in FIGS. 4 and 5, in the embodiment shown in FIGS. 8 and 9, a cam-like extension 25 is provided on the end surface 24 of the spark plug body 5. A rod-shaped ground electrode 7 that extends in a straight line is not welded to the inner surface 26 of the cam-like extension 25, but rather to an end surface of the cam-like extension 25. In this case, a capacitor discharge welding, for example, may be advantageous. The weld between the ground electrode 7 and the cam-like extension 25 extends across the entire thickness of the cam-like extension 25 extending transversely relative to the longitudinal direction 9 in order to ensure good heat dissipation from the ground electrode 7.

LIST OF REFERENCE NUMERALS

| | | | |
|---|---|---|---|
| 1. | Spark plug | A | Step height |
| 2. | Inner conductor | B | Width |
| 3. | Center electrode | H | Height |
| 4. | Insulator | | |
| 5. | Spark plug body | | |
| 6. | Front end | | |
| 7. | Ground electrode | | |
| 8. | Thread | | |
| 9. | Longitudinal direction | | |
| 10. | Electrode end section | | |
| 11. | $1^{st}$ end | | |
| 12. | $2^{nd}$ end | | |
| 13. | End surface of ground electrode | | |
| 14. | Side surface of ground electrode | | |
| 15. | Side surface of ground electrode | | |
| 16. | Step | | |
| 17. | Precious metal component | | |
| 18. | Ignition surface | | |
| 19. | Spark air gap | | |
| 20. | End surface | | |
| 21. | Precious metal component | | |
| 22. | Interstice | | |
| 23. | Surface | | |
| 24. | End surface | | |
| 25. | Cam-like extension | | |
| 26. | Inside | | |
| 27. | Copper core | | |
| 28. | Weld | | |

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

A used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug, comprising:

a center electrode extending in a longitudinal direction of the spark plug;

a spark plug body having a front end and a rear end;

a rod-shaped ground electrode being attached to the front end of the spark plug body and having an electrode end section extending transversely relative to the longitudinal direction of the spark plug, the electrode end section having a step, an end surface, and two side surfaces with the end surface and the two side surfaces being oriented in the longitudinal direction of the spark plug, the two side surfaces defining a width (B) of the electrode end section that extends transversely relative to the longitudinal direction of the spark plug, and the two side surfaces being connected to each other by the end surface;

a precious metal component being attached to the step of the electrode end section and having an ignition surface, the precious metal component being flush with the end surface of the electrode end section, the ignition surface of the precious metal component being oriented transversely relative to the end surface of the electrode end section and, the ignition surface of the precious metal component together with the center electrode forming a spark air gap;

wherein the step of the electrode end section and the precious metal component extend across the entire width (B) of the electrode end section so that the precious metal component is flush with the electrode end section on the two side surfaces as well as on the end surface, and the precious metal component and the electrode end section are attached by means of a welding seam that forms an alloy zone composed of the materials of the precious metal component and the electrode end section, the welding seam extends along an interstice that is between the precious metal component and the electrode end section and is located on the end surface of the electrode end section, on the surface of the electrode end section that adjoins the precious metal component and is oriented towards the center electrode, and on the two side surfaces of the electrode end section.

2. The spark plug according to claim 1, wherein the two sides surfaces of the electrode end section extend parallel to each other.

3. The spark plug according to claim 1, wherein the ignition surface of the precious metal component is flush with a surface of the electrode end section that adjoins the precious metal component and is oriented towards the center electrode.

4. The spark plug according to claim 1, wherein the precious metal component is block-shaped and the end surface of the electrode end section is formed by a plane extending parallel to the longitudinal direction of the spark plug.

5. The spark plug according to claim 1, wherein the front end of the spark plug body has a cam-like extension onto which is welded a rod-shaped ground electrode that extends in a straight line.

6. The spark plug according to claim 1, wherein the electrode end section of the ground electrode is composed of a nickel-based alloy.

7. The spark plug according to claim 6, wherein the ground electrode has a copper core.

8. A spark plug, comprising:

a center electrode extending in a longitudinal direction of the spark plug;

a spark plug body having a front end and a rear end;

a rod-shaped ground electrode being attached to the front end of the spark plug body and having an electrode end section extending transversely relative to the longitudinal direction of the spark plug, the electrode end section having a step, an end surface, and two side surfaces with the end surface and the two side surfaces being oriented in the longitudinal direction of the spark plug, the two side surfaces defining a width (B) of the electrode end section that extends transversely relative to the longitudinal direction of the spark plug, and the two side surfaces being connected to each other by the end surface;

a precious metal component being attached to the step of the electrode end section and having an ignition surface, the precious metal component being flush with the end surface of the electrode end section, the ignition surface of the precious metal component being oriented transversely relative to the end surface of the electrode end section and, the ignition surface of the precious metal component together with the center electrode forming a spark air gap;

wherein the step of the electrode end section and the precious metal component extend across the entire width (B) of the electrode end section so that the precious metal component is flush with the electrode end section on the two side surfaces as well as on the end surface, and the ignition surface of the precious metal component protrudes in step fashion beyond a surface of the electrode end section that adjoins the precious metal component and is oriented towards the center electrode, and the ignition surface protrudes in step fashion by a height (A) that is from 0.1 mm to 0.8 mm.

9. A spark plug, comprising:

a center electrode extending in a longitudinal direction of the spark plug;

a spark plug body having a front end and a rear end;

a rod-shaped ground electrode being attached to the front end of the spark plug body and having an electrode end section extending transversely relative to the longitudinal direction of the spark plug, the electrode end section having a step, an end surface, and two side surfaces with the end surface and the two side surfaces being oriented in the longitudinal direction of the spark plug, the two side surfaces defining a width (B) of the electrode end section that extends transversely relative to the longitudinal direction of the spark plug, and the two side surfaces being connected to each other by the end surface;

a precious metal component being attached to the step of the electrode end section and having an ignition surface, the precious metal component being flush with the end surface of the electrode end section, the ignition surface of the precious metal component being oriented transversely relative to the end surface of the electrode end section and, the ignition surface of the precious metal component together with the center electrode forming a spark air gap;

wherein the step of the electrode end section and the precious metal component extend across the entire width (B) of the electrode end section so that the precious metal component is flush with the electrode end section on the two side surfaces as well as on the end surface, and the precious metal component is disk-shaped and the end surface of the electrode end section is provided in the form of a part of a circumferential surface of a cylinder whose longitudinal axis extends parallel to the longitudinal direction of the spark plug.

* * * * *